US009004487B2

(12) United States Patent
Takayasu

(10) Patent No.: US 9,004,487 B2
(45) Date of Patent: Apr. 14, 2015

(54) SHEET CONVEYING DEVICE AND IMAGE FORMING APPARATUS

(71) Applicant: Masanori Takayasu, Ibaraki (JP)

(72) Inventor: Masanori Takayasu, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/086,064

(22) Filed: Nov. 21, 2013

(65) Prior Publication Data

US 2014/0183812 A1 Jul. 3, 2014

(30) Foreign Application Priority Data

Dec. 28, 2012 (JP) ..... 2012-287141

(51) Int. Cl.
*B65H 7/02* (2006.01)
*B65H 5/06* (2006.01)

(52) U.S. Cl.
CPC ..... *B65H 7/02* (2013.01); *B65H 5/062* (2013.01); *B65H 2402/31* (2013.01); *B65H 2402/32* (2013.01); *B65H 2404/1341* (2013.01); *B65H 2511/11* (2013.01); *B65H 2511/22* (2013.01); *B65H 2511/33* (2013.01); *B65H 2553/51* (2013.01); *B65H 2553/81* (2013.01); *B65H 2701/1311* (2013.01); *B65H 2701/1313* (2013.01)

(58) Field of Classification Search
CPC ..... B65H 5/062; B65H 7/02; B65H 2511/11; B65H 2553/51
USPC ..... 271/272–274, 265.02
See application file for complete search history.

(56) References Cited

U.S. PATENT DOCUMENTS

| | | | | |
|---|---|---|---|---|
| 7,517,077 | B2 * | 4/2009 | Ishii et al. | 347/104 |
| 7,887,052 | B2 * | 2/2011 | Krasuski | 271/272 |
| 8,131,171 | B2 | 3/2012 | Ohshima et al. | |
| 8,320,814 | B2 * | 11/2012 | Tsukamoto et al. | 399/389 |
| 8,328,192 | B2 * | 12/2012 | Yamazaki et al. | 271/265.04 |
| 8,538,311 | B2 * | 9/2013 | Ohshima et al. | 399/389 |
| 2010/0329759 | A1 | 12/2010 | Furuya et al. | |
| 2011/0020020 | A1 * | 1/2011 | Ohshima et al. | 399/45 |
| 2011/0062659 | A1 * | 3/2011 | Richards et al. | 271/264 |
| 2012/0139180 | A1 * | 6/2012 | Ohshima et al. | 271/258.01 |
| 2013/0195482 | A1 | 8/2013 | Nakura et al. | |
| 2014/0175740 | A1 * | 6/2014 | Ikeda | 271/272 |

FOREIGN PATENT DOCUMENTS

| | | |
|---|---|---|
| JP | 62-036945 | 8/1987 |
| JP | 3347361 | 11/2002 |
| JP | 2004-109895 | 4/2004 |
| JP | 2007-238251 | 9/2007 |
| JP | 2011-006202 | 1/2011 |
| JP | 2011-020842 | 2/2011 |
| JP | 2013-053004 | 3/2013 |

* cited by examiner

*Primary Examiner* — Patrick Cicchino
(74) *Attorney, Agent, or Firm* — IPUSA, PLLC

(57) ABSTRACT

A sheet conveying device includes a conveying unit configured to convey a sheet by a first rotating body and a second rotating body that is provided so as to be movable in a contacting/separating direction with respect to the first rotating body; a rotation amount measuring unit configured to measure a rotation amount of the second rotating body, the rotation amount measuring unit being provided so as to be movable in the contacting/separating direction along with the second rotating body; and a conveying distance calculating unit configured to calculate a conveying distance of the sheet based on a measurement result obtained by the rotation amount measuring unit.

9 Claims, 6 Drawing Sheets

SHEET CONVEYING DEVICE AND IMAGE FORMING APPARATUS

BACKGROUND OF THE INVENTION

1. Field of the Invention

The present invention relates to a sheet conveying device and an image forming apparatus.

2. Description of the Related Art

In the commercial printing business, when printing by small lots, multiple types, multiple data, etc., instead of using the conventional offset printing machine, POD (Print On Demand) by an image forming apparatus using an electrophotographic method, etc. is increasingly being applied. In order to meet such demand, for example, image forming apparatuses of an electrophotographic method are required to have precision in the front/back estimation and evenness in images, which are equal to those of an offset printing machine.

The factors causing the deviation in the front/back estimation in the image forming apparatus can be largely divided into registration errors in the vertical direction/horizontal direction, skew errors between the recording medium and the print image, and the expansion and contraction in the length of the image when transferring a toner image. Furthermore, in an image forming apparatus including a fixing device, a deviation in the front/back estimation is caused by the error in the magnification ratio of the image, according to the expansion and contraction in the recording medium when heated by the fixing device.

Such a deviation in the front/back estimation can be prevented by, for example, measuring the length of the sheet in the conveying direction before and after fixing the toner image, and correcting the image to be printed on the back side of the sheet based on the expansion/contraction ratio of the sheet.

Accordingly, there is disclosed a sheet length measuring device for detecting, with a rotary encoder, the rotation amount of a length measuring roller that is rotated by being in contact with a conveyed sheet, and calculating the length of the sheet in the conveying direction based on the detected rotation amount of the length measuring roller (see, for example, Patent Document 1).

Patent Document 1: Japanese Laid-Open Patent Publication No. 2011-6202

However, in the sheet length measuring device of Patent Document 1, in order to cause the length measuring roller to be rotated by being in contact with sheets of various thicknesses, for example, the length measuring roller is configured to be movable in the thickness direction of the sheet. In such a configuration, for example, the, rotary encoder is fixed to the apparatus frame, and is connected to the rotational shaft of the length measuring roller by a universal joint, etc., to detect the rotation amount of the rotational shaft that rotates along with the length measuring roller.

In the case of the above configuration, for example, a universal joint is required between the length measuring roller and the rotary encoder, and therefore the cost may increase. Furthermore, space is required for connecting the length measuring roller with the rotary encoder, and therefore the size of the apparatuses may increase.

SUMMARY OF THE INVENTION

The present invention provides a sheet conveying device and an image forming apparatus, in which one or more of the above-described disadvantages are eliminated.

According to an aspect of the present invention, there is provided a sheet conveying device including a conveying unit configured to convey a sheet by a first rotating body and a second rotating body that is provided so as to be movable in a contacting/separating direction with respect to the first rotating body; a rotation amount measuring unit configured to measure a rotation amount of the second rotating body, the rotation amount measuring unit being provided so as to be movable in the contacting/separating direction along with the second rotating body; and a conveying distance calculating unit configured to calculate a conveying distance of the sheet based on a measurement result obtained by the rotation amount measuring unit.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

Figure 1:
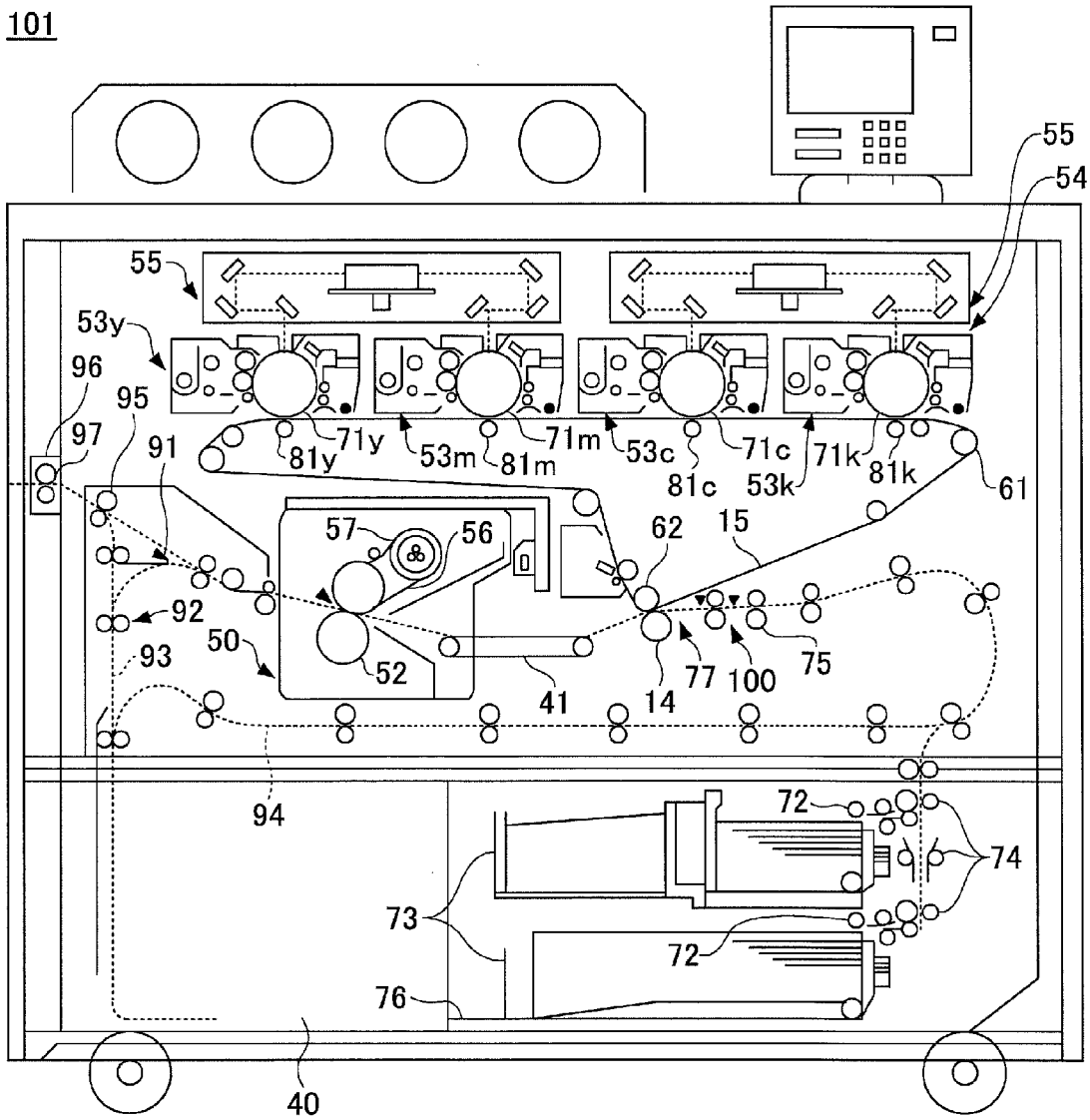
FIG. 1 schematically illustrates an example of an image forming apparatus according to an embodiment of the present invention.

A description is given, with reference to the accompanying drawings, of embodiments of the present invention. In the drawings, the same elements are denoted by the same reference numerals, and redundant descriptions may be omitted.

Configuration of Image Forming Apparatus

FIG. 1 schematically illustrates an example of an image forming apparatus 101 according to the present embodiment.

The image forming apparatus 101 forms images on a sheet S that is a recording medium such as a paper sheet and an OHP, by an image forming means including a tandem image forming device 54, an intermediate transfer belt 15, a secondary transfer device 77, and a fixing device 50.

The tandem image forming device 54 includes a plurality of developing devices 53*y*, 53*m*, 53*c*, 53*k* (hereinafter, described without the letters y, m, c, k) which are disposed along the intermediate transfer belt 15. Above the tandem image forming device 54, there is provided an exposing device 55. Each of the developing devices 53 of the tandem image forming device 54 includes a photoconductive drum 71 as an image carrier for carrying the toner images of the respective colors.

Furthermore, at the primary transfer position where the toner image is transferred from the photoconductive drum 71 to the intermediate transfer belt 15, a primary transfer roller 81 is provided so as to face the photoconductive drum 71 with the intermediate transfer belt 15 sandwiched between the primary transfer roller 81 and the photoconductive drum 71.

The secondary transfer device 77 is provided on the opposite side (on the downstream side of the intermediate transfer belt 15 in the conveying direction) of the tandem image forming device 54 across the intermediate transfer belt 15. The secondary transfer device 77 transfers the image on the intermediate transfer belt 15 onto a sheet S, by pressing a secondary transfer roller 14 against a roller 62 acting as a secondary transfer facing roller to apply a transfer electric field. The secondary transfer device 77 changes the transfer current of the secondary transfer roller 14 that is a parameter of transfer conditions, according to the type, etc., of the sheet S.

Furthermore, the image forming apparatus 101 includes a sheet conveying device 100 that can calculate the conveying distance of the sheet S and the length of the sheet S in the conveying direction (hereinafter, "sheet length"), and conveys the sheet S by a configuration and a method described below, and calculates the conveying distance and the sheet length of the sheet S.

The fixing device 50 includes a halogen lamp 57 acting as a heat source, and includes a pressurizing roller 52 pressed against a fixing belt 56 which is an endless belt. The fixing device 50 changes parameters of fixing conditions including the temperature of the fixing belt 56 and the pressurizing roller 52, the nip width between the fixing belt 56 and the pressurizing roller 52, and the speed of the pressurizing roller 52, according to the sheet S. A conveying belt 41 conveys the sheet S onto which an image has been transferred, from the secondary transfer device 77 to the fixing device 50.

In the image forming apparatus 101, when image data is sent and a signal to start creating an image is received, a driving motor (not shown) rotates a roller 61, to rotate the intermediate transfer belt 15. At the same time, the developing devices 53 respectively form images of the corresponding monochrome colors on the corresponding photoconductive drums 71. Then, the monochrome images formed at the developing devices 53 are sequentially superposed on the rotating intermediate transfer belt 15, so that a composite color image is formed.

Furthermore, the sheet S is paid out from one of the sheet feeding cassettes 73 as one of the sheet feeding rollers 72 of a sheet feeding table 76 is selected and rotated, conveyed by conveying rollers 74, and is caused to abut against a resist roller 75 and stopped. The resist roller 75 straightens the conveying posture of the sheet S (straightens the skew of the sheet S with respect to the conveying direction), and conveys the sheet S so as to meet the timing when the composite color image on the intermediate transfer belt 15 reaches the secondary transfer device 77. The composite color image formed on the intermediate transfer belt 15 is transferred onto the front side of the sheet S conveyed to the secondary transfer device 77.

The sheet S onto which the image has been transferred is conveyed by the conveying belt 41 to the fixing device 50, where heat and pressure is applied to the sheet S so that the transferred image is caused to melt and to be fixed on the sheet S. After the image is fixed onto the front side of the sheet S, in the case of double-sided printing, the sheet S is conveyed to a sheet reversing path 93 by a branch claw 91 and a flip roller 92. Subsequently, the sheet S is switched back by a branch claw/roller pair (not shown) and conveyed to a double-side conveying path 94, and a composite color image is formed on the back side of the sheet S.

Furthermore, when the sheet is reversed and discharged, the branch claw 91 guides the sheet S to the sheet reversing path 93, where the sheet S is reversed from the front side to the back side and discharged. In the case of single-sided printing and the sheet is not reversed, the branch claw 91 conveys the sheet S to a sheet discharge roller 95.

Subsequently, the sheet discharge roller 95 conveys the sheet S to a decurler unit 96. At the decurler unit 96, the decurling amount is changed according to the sheet. The decurling amount is adjusted by changing the pressure of a decurler roller 97, and the sheet S is discharged by the decurler roller 97. A purge tray 40 is disposed below the reverse discharging unit.

Note that as a resist mechanism for correcting the position of the sheet S in the conveying direction and the position of the sheet S in the width direction orthogonal to the conveying direction, for example, a resist gate and a skew correction mechanism may be provided instead of the resist roller 75. In this case, the sheet conveying device 100 controls the timing of conveying the sheet S to a secondary transfer part between the roller 62 and the secondary transfer roller 14. Specifically, the sheet conveying device 100 controls the conveying speed of the sheet S based on a detection result obtained by a sheet detection sensor provided between the resist mechanism and the sheet conveying device 100, so that the timing at which the toner image on the intermediate transfer belt 15 reaches the secondary transfer part matches the timing at which the sheet S reaches the secondary transfer part.

Note that the image forming apparatus 101 according to the present embodiment has a configuration of transferring the color toner image formed on the intermediate transfer belt 15 onto the sheet S; however, the monochrome toner images formed on the plurality of photoconductive drums 71 may be directly transferred to and superposed on the sheet S. Furthermore, the image forming apparatus 101 may be a monochrome image forming apparatus for forming a monochrome image. Furthermore, the image forming method is not limited to the electrophotographic method; for example, an inkjet method may be applied.

Configuration of Sheet Conveying Device

Figure 2:
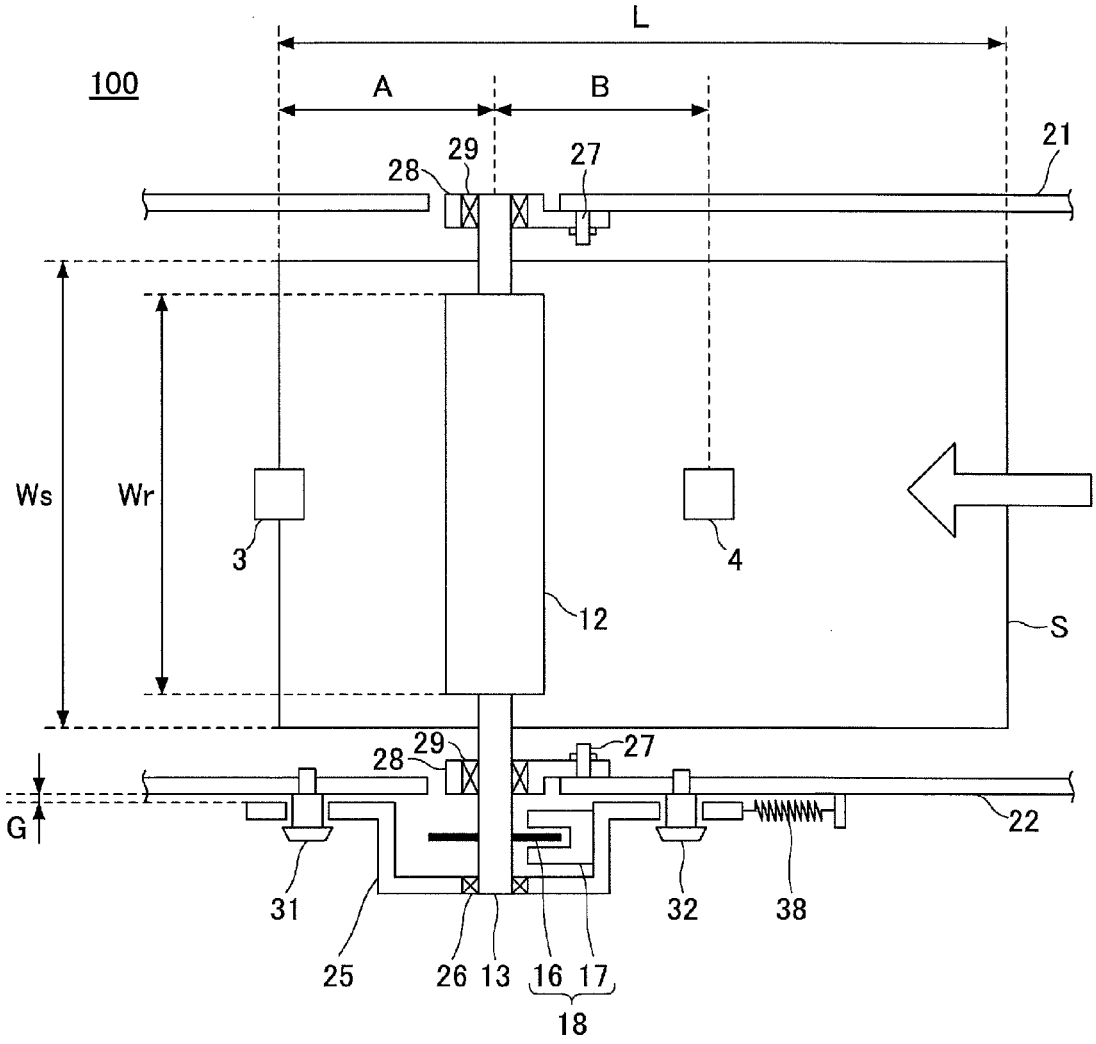
FIG. 2 is a top view of an example of a schematic configuration of a sheet conveying device according to an embodiment of the present invention.
Figure 3:
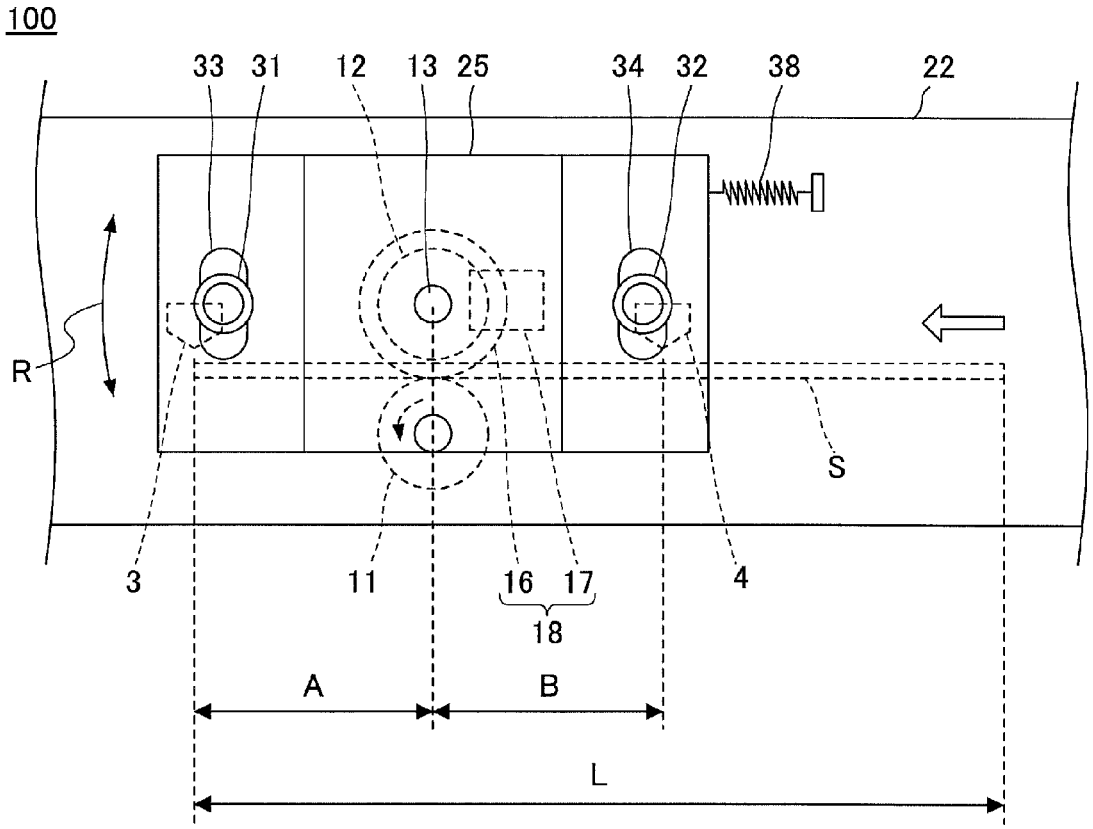
FIG. 3 is a side view of an example of a schematic configuration of the sheet conveying device according to an embodiment of the present invention.
Figure 4:
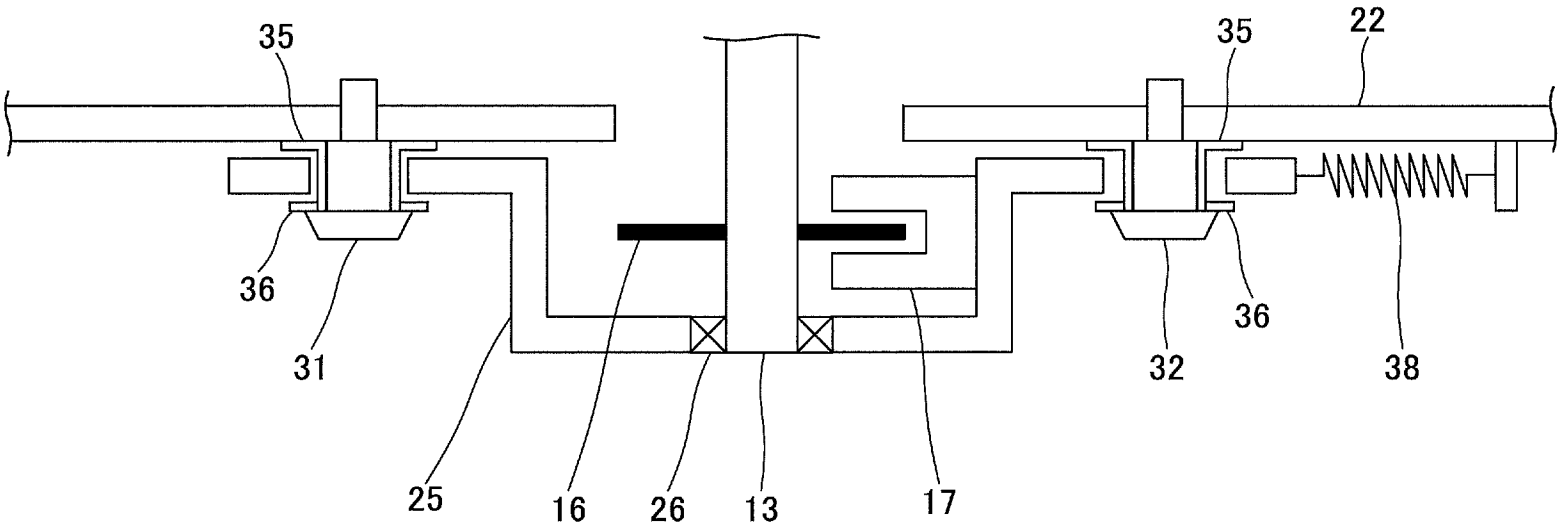
FIG. 4 is an enlarged view of an example of relevant parts of the sheet conveying device according to an embodiment of the present invention.

Next, the configuration of the sheet conveying device 100 included in the image forming apparatus 101 is described with reference to FIGS. 2 through 4. FIG. 2 is a top view of an example of a schematic configuration of the sheet conveying device 100, FIG. 3 is a side view of an example of a schematic configuration of the sheet conveying device 100, and FIG. 4 is an enlarged view of an example of relevant parts of the sheet conveying device 100.

The sheet conveying device 100 conveys the sheet S, and calculates the conveying distance or the sheet length of the sheet S. The sheet conveying device 100 is provided at a directly upstream side of the secondary transfer device 77 for transferring image onto the sheet S, in the conveying path of the sheet S.

Driving Roller and Driven Roller

The sheet conveying device 100 includes a driving roller 11 that rotates, and a driven roller 12 that is provided facing the driving roller 11 to be rotated by the driving roller 11. The sheet S is held and conveyed in the white-out arrow direction in FIGS. 2 and 3, between the driving roller 11 and the driven roller 12 that are examples of conveying means.

The driving roller 11 is an example of a first rotating body, which rotates in a direction indicated by a dashed line arrow in FIG. 3 by receiving a driving force from a driving means such as a motor, via a driving force transmitting means such as a gear and a belt (not shown). As the driving roller 11, for example, a metal roller for securing axial deflection precision is used, and a rubber layer is provided on the surface of the metal roller for sufficiently maintaining the frictional force between the sheet S and the metal roller.

The driven roller 12 is an example of a second rotating body, which is provided so as to be movable in a direction of contacting and separating from the driving roller 11 (contacting/separating direction), and which is biased toward the driving roller 11 by a biasing means (not shown). The driven roller 12 is rotated by the driving roller 11 when the sheet S is not conveyed, and is rotated by the sheet S when the sheet S is conveyed.

As shown in FIG. 2, in the driving roller 11, the width Wr in the width direction orthogonal to the conveying direction of the sheet S is shorter than the minimum width Ws of the sheet S that can be used in the sheet conveying device 100. Thus, the driving roller 11 does not contact the driven roller 12 when the sheet S is conveyed, and therefore the driving roller 11 is rotated only by the friction generated between the driving roller 11 and the sheet S. Accordingly, when the sheet S is being conveyed, the driving roller 11 rotates without being affected by the driven roller 12, and the conveying distance of the sheet S can be obtained more accurately by a method described below.

Furthermore, as the driven roller 12, for example, a metal roller for securing axial deflection precision is used, and a rubber layer is provided on the surface of the metal roller so that the driven roller 12 is reliably rotated by the frictional force between the sheet S and the metal roller, without slipping against the sheet S.

As shown in FIG. 2, the driven roller 12 is supported by ball bearings 29 of holding members 28 that are rotatably provided centering around pins 27 used for fixing both ends of a rotational shaft 13 to frames 21, 22, so that the driven roller 12 is provided so as to be rotatable and movable in a direction of contacting and separating from the driving roller 11.

Rotary Encoder and Support Member

As shown in FIG. 2, the rotational shaft 13 of the driven roller 12 is provided with an encoder wheel 16 having slits carved on the surface at constant intervals, and a support member 25 for supporting an encoder sensor 17 for detecting the slits of the encoder wheel 16. The encoder wheel 16 and the encoder sensor 17 constitute a rotary encoder 18, which is an example of a rotation amount measuring means.

The support member 25 rotatably supports the rotational shaft 13 of the driven roller 12 with ball bearings 26, and as shown in FIG. 3, the support member 25 is movably mounted to the frame 22 by stepped screws 31, 32 which are inserted into long holes 33, 34. The support member 25 is mounted to the frame 22 by the stepped screws 31, 32 so that a gap G can be formed between the support member 25 and the frame 22, as shown in FIG. 2. If the gap G is too large, the support member 25 may come off the frame 22 or may be locked to the frame 22, and therefore the gap G is preferably greater than or equal to 0.1 mm and less than or equal to 3 mm.

By such a configuration, the support member 25 rotates in a direction indicated by an arrow R in FIG. 3 along the shapes of the long holes 33, 34, in accordance with the movement of the driven roller 12 in a direction of contacting and separating from the driving roller 11. For example, when the support member 25 and the stepped screws 31, 32 are formed by a metal material, there may be a possibility that the support member 25 does not move smoothly due to friction. Therefore, as illustrated in FIG. 4, as examples of resin members, a sliding bearing 35 made of resin and a washer 36 made of resin are provided at the parts of the stepped screws 31, 32 contacting the support member 25. According to the resin members provided on at least the parts of the stepped screws 31, 32 contacting the support member 25, the frictional force between the stepped screws 31, 32 and the support member 25 is reduced, so that the support member 25 can move smoothly according to the movement of the driven roller 12.

Furthermore, the support member 25 receives a pressing force from a coil spring 38 as an example of a pressing means. The coil spring 38 applies a pressing force on the support member 25, in order to mitigate the positional variation of the encoder sensor 17 with respect to the encoder wheel 16. The direction in which the coil spring 38 presses the support member 25 is preferably in a direction that is substantially orthogonal to the contacting/separating direction of the driven roller 12, so as not to hamper the contacting/separating movement of the driven roller 12.

Note that in the present embodiment, the rotary encoder 18 is provided on the rotational shaft of the driving roller 11; however, the rotary encoder 18 may be provided on the rotational shaft of the driven roller 12. Note that the diameter of the rotational shaft on which the rotary encoder 18 is provided is preferably as small as possible, because when the diameter is small, the revolution speed according to sheet conveyance increases and the number of pulses to be counted increases, and the conveying distance of the sheet S can be measured at high precision.

When the driven roller 12 starts to be rotated by the driving roller 11 or the sheet S, the encoder sensor 17 of the rotary encoder 18 detects the slits of the encoder wheel 16 that rotates together with the driven roller 12, and outputs pulses.

The pulses output from the rotary encoder 18 are counted by a pulse counting means, and are used for calculating the conveying distance and the sheet length of the sheet S.

As described above, in the sheet conveying device 100 according to the present embodiment, the rotary encoder 18, which is constituted by the encoder wheel 16 and the encoder sensor 17, is provided on the rotational shaft 13 of the driven roller 12 together with the support member 25. Therefore, the rotary encoder 18 moves according to the contacting/separating movement of the driven roller 12 with respect to the driving roller 11. Accordingly, there is no need to provide components such as a universal joint for connecting the rotational shaft 13 of the driven roller 12 with the rotary encoder 18, so that costs can be reduced and the size can be made compact.

Sheet Detection Sensor

On the downstream side of the driving roller 11 and the driven roller 12 in the conveying direction of the sheet S, there is provided a start trigger sensor 3 for detecting the passage of the leading end of the sheet S, as an example of a downstream side detection means. Furthermore, on the upstream side of the driving roller 11 and the driven roller 12 in the conveying direction of the sheet S, there is provided a stop trigger sensor 4 for detecting the passage of the trailing end of the sheet S, as an example of an upstream side detection means.

The start trigger sensor 3 and the stop trigger sensor 4 are reflective photosensors; however, the start trigger sensor 3 and the stop trigger sensor 4 may be other types of sensors such as a transmission photosensor, as long as the end of the sheet S can be detected.

The start trigger sensor 3 and the stop trigger sensor 4 may be disposed at a position shifted in any direction from the center position in the width direction orthogonal to the conveying direction of the sheet S, as long as they are within an area where the sheet S passes. However, the start trigger sensor 3 and the stop trigger sensor 4 are preferably provided at substantially the same position in the width direction, in order to minimize the impact of the conveying posture of the sheet S (the skew of the sheet S with respect to the conveying direction) and to measure the conveying distance of the sheet S more accurately.

A distance A indicated in FIGS. 2 and 3 is the distance between the start trigger sensor 3, and the driving roller 11 and the driven roller 12, in the conveying path of the sheet S. A distance B indicated in FIGS. 2 and 3 is the distance between the stop trigger sensor 4, and the driving roller 11 and the driven roller 12. The distances A and B are preferably as short as possible, because the pulse count range described below becomes large.

The pulse counting means for counting pulses output from the rotary encoder 18, starts counting pulses when the start trigger sensor 3 detects the leading end of the sheet S. Furthermore, the pulse counting means ends the counting of pulses when the stop trigger sensor 4 detects the trailing end of the sheet S. Based on the number of pulses counted by the pulse counting means, the conveying distance or the sheet length of the sheet S is obtained by a method described below.

The sheet conveying device 100 according to the present embodiment has the configuration described above, and conveys the sheet S by the driving roller 11 and the driven roller 12 and calculates the conveying distance or the sheet length of the sheet S.

The image forming apparatus 101 corrects the magnification ratio of the image to be printed on a second side of the sheet S based on the calculated conveying distance or sheet length of the sheet S and based on the expansion/contraction ratio before and after printing on a first side of the sheet S, and therefore the precision in the front/back estimation can be increased.

Functional Configuration of Image Forming Apparatus

Figure 5:
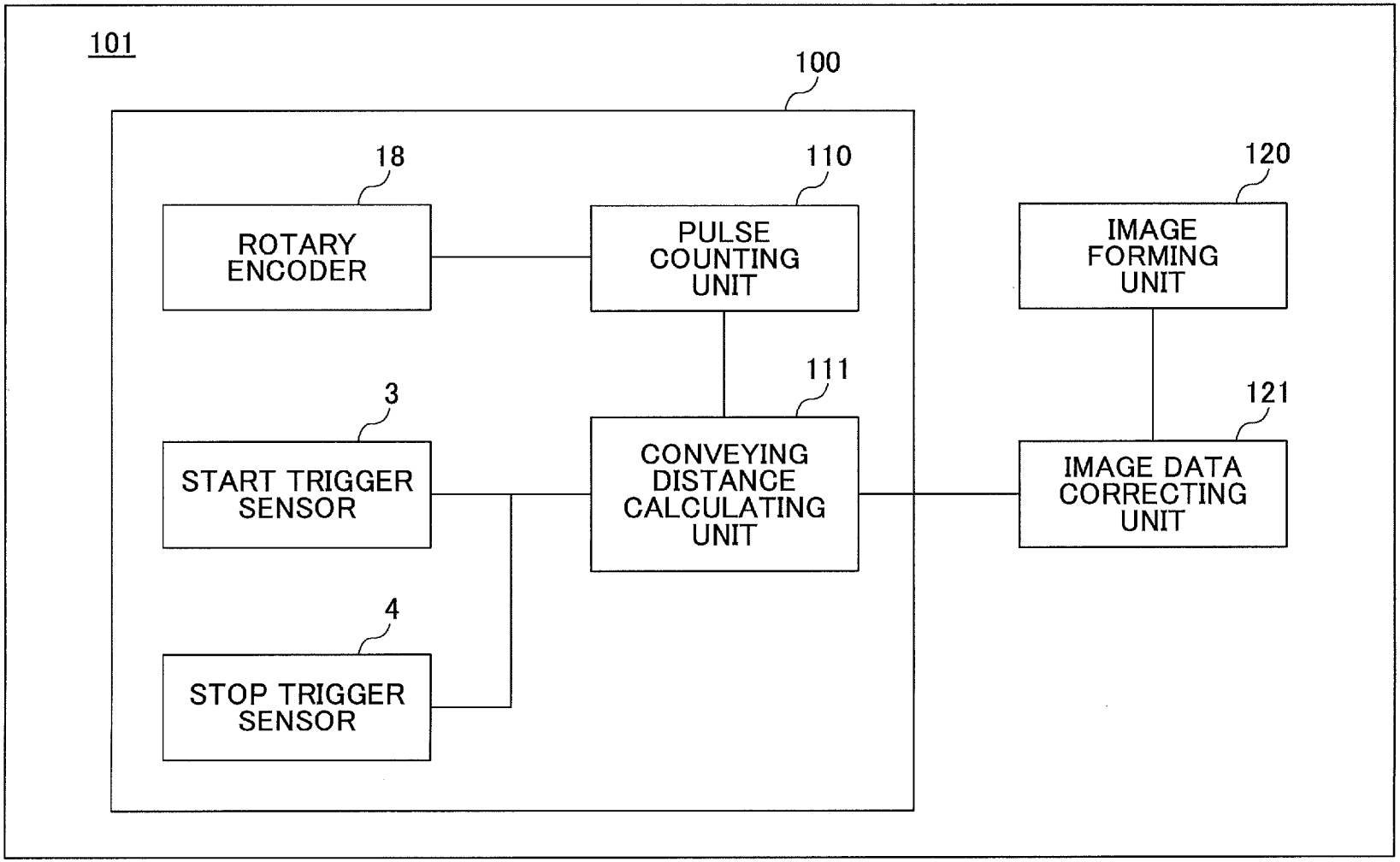
FIG. 5 is a block diagram illustrating an example of a functional configuration of the image forming apparatus according to an embodiment of the present invention.

FIG. 5 is a block diagram illustrating an example of a functional configuration of the image forming apparatus 101 according to the present embodiment.

As illustrated in FIG. 5, the image forming apparatus 101 includes the sheet conveying device 100, an image forming unit 120, and an image data correcting unit 121.

The sheet conveying device 100 includes the start trigger sensor 3, the stop trigger sensor 4, the rotary encoder 18, a pulse counting unit 110, and a conveying distance calculating unit 111.

The pulse counting unit 110 counts the pulses output from the encoder sensor 17 according to the rotation of the encoder wheel 16 of the rotary encoder 18 provided on the driven roller 12, and measures the rotation amount of the driven roller 12.

The conveying distance calculating unit 111 calculates the conveying distance of the sheet S or the length of the sheet S in the conveying direction by a method described below, based on the rotation amount of the driven roller 12 measured by the pulse counting unit 110.

The image forming unit 120 includes the tandem image forming device 54, the exposing device 55, the secondary transfer device 77, etc., and forms toner images on the sheet S.

The image data correcting unit 121 calculates the expansion/contraction ratio of the sheet S before and after printing on the first side, based on the conveying distance or the sheet length of the sheet S obtained by the conveying distance calculating unit 111, and corrects the magnification ratio of the image to be formed on the second side of the sheet S.

For example, The pulse counting unit 110, the conveying distance calculating unit 111, and the image data correcting means are realized by having a CPU execute programs stored in a storage means such as a ROM.

Method of Calculating Sheet Conveying Distance

Next, a description is given of a method of calculating the conveying distance of the sheet S performed by the conveying distance calculating unit 111.

Figure 6:
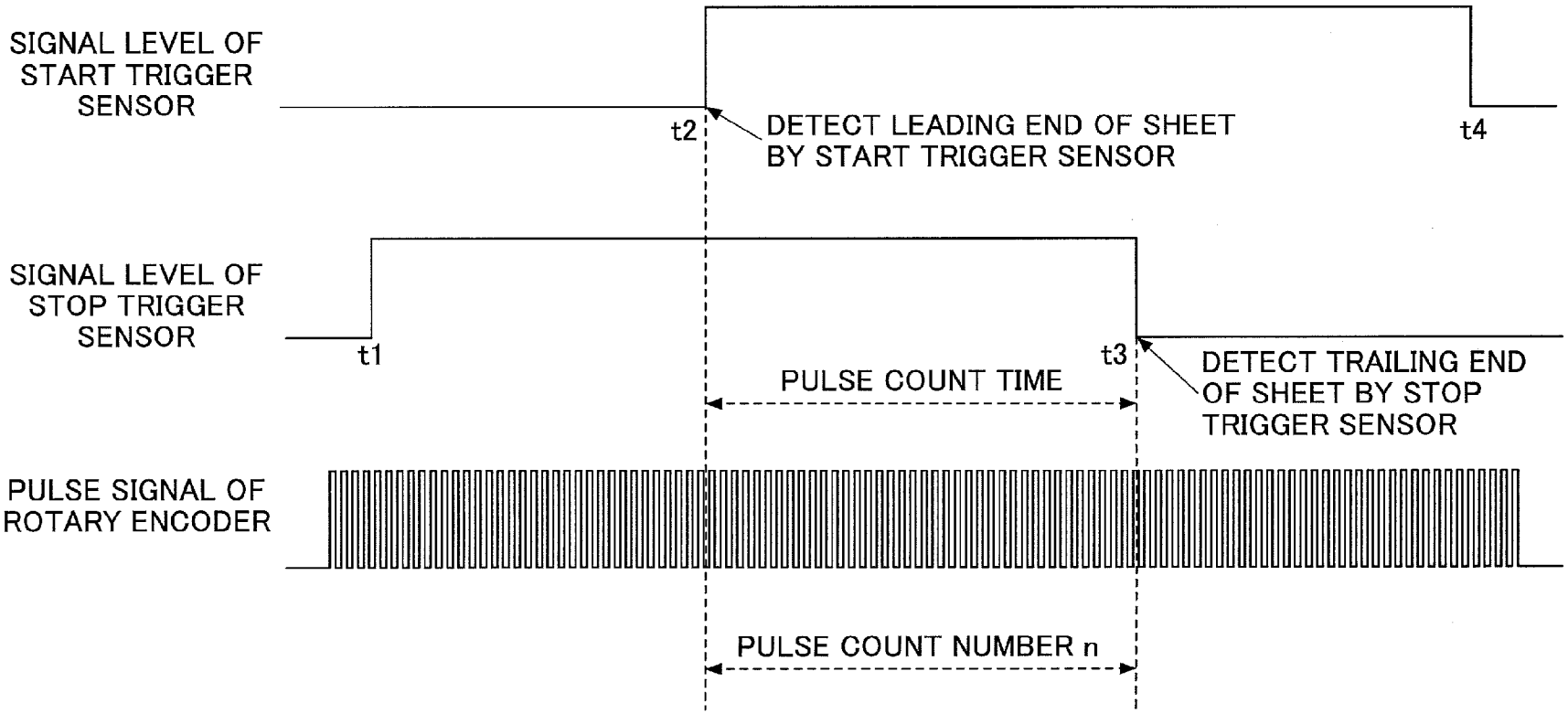
FIG. 6 illustrates output examples of a rotary encoder, a start trigger sensor, and a stop trigger sensor.

FIG. 6 illustrates output examples of the start trigger sensor 3, the stop trigger sensor 4, and the rotary encoder 18.

As described above, when the driven roller 12 rotates, the rotary encoder 18 provided on the rotational shaft of the driven roller 12 outputs pulses.

In the example of FIG. 6, after the sheet S is fed out in the image forming apparatus 101, the stop trigger sensor 4 detects the passage of the leading end of the sheet S at a time t1, and the start trigger sensor 3 detects the passage of the leading end of the sheet S at a time t2.

Next, the stop trigger sensor 4 detects the passage of the trailing end of the sheet S at a time t3, and the start trigger sensor 3 detects the passage of the trailing end of the sheet S at a time t4.

At this time, during a pulse count time from when the start trigger sensor 3 detects the leading end of the sheet S at the time t2 to when the stop trigger sensor 4 detects the trailing end of the sheet S at the time t3, the pulse counting unit 110 counts the pulses of the rotary encoder 18.

It is assumed that the driven roller 12 on which the rotary encoder 18 is provided has a radius r, the number of encoder pulses while the driven roller 12 rotates once is N, and the number of pulses counted during the pulse count time is n. In this case, the conveying distance L of the sheet S between, the time t2 and the time t3 can be obtained by the following formula (1).

$$L=(n/N)\times 2\pi r \quad (1)$$

n: counted number of pulses

N: number of encoder pulses while driven roller rotates once [/r]

r: radius of driven roller 12 [mm]

Generally, the sheet conveying speed varies according to the precision of the outer shape of the roller conveying the sheet S (particularly the driven roller 12), the machine precision such as the core deflection precision, the rotation precision of the motor, etc., and the precision in the power transmitting mechanism such as a gear and a belt. Furthermore, the sheet conveying speed also varies due to a slip phenomenon between the driven roller 12 and the sheet S, and a loosening phenomenon caused by the difference in the sheet conveying force or the sheet conveying speed between the conveying means on upstream side and the downstream side. Therefore, the pulse period and the pulse width output from the rotary encoder 18 constantly change; however, the number of pulses does not change.

Therefore, the conveying distance calculating unit 111 can obtain, by formula (1) with high precision, the conveying distance L of the sheet S conveyed by the driving roller 11 and the driven roller 12 acting as conveying means, without depending on the sheet conveying speed, etc.

For example, the image data correcting unit 121 can obtain the relative ratio such as the ratio between pages of the sheet S and the front/back ratio of the sheet S, etc., based on the calculation result obtained by the conveying distance calculating unit 111.

The image data correcting unit 121 can obtain the expansion/contraction ratio R by the following formula (2), from the relative ratio of the sheet conveying distance before and after the heat fixing during the operation of printing on the first side in the image forming apparatus 101, obtained by the conveying distance calculating unit 111.

$$R=[(n2/N)\times 2\pi r]/[(n1/N)\times 2\pi r] \quad (2)$$

n1: counted number of pulses when conveying the sheet S before heat fixing n2: counted number of pulses when conveying the sheet S after heat fixing Examples of preliminary calculations according to the present embodiment are described below.

In the present embodiment, the conveying distance L1 of the sheet S is obtained as follows, in a case where N=2800 [/r], r=9 [mm], and the counted number of pulses when a sheet of an A3 size is vertically conveyed is n1=18816.

$$L1=(18816/2800)\times 2\pi\times 9=380.00\ [\mathrm{mm}]$$

Furthermore, the conveying distance L2 of the sheet S is obtained as follows, in a case where the number of pulses counted again after the heat fixing on the sheet S is n2=18759.

$$L2=(18759/2800)\times 2\pi\times 9=378.86\ [\mathrm{mm}]$$

The front/back difference in the conveying distance of the sheet S is obtained as follows.

$$\Delta L=380.00-378.86=1.14\ [\mathrm{mm}]$$

Based on the calculation result of the conveying distance of the front/back of the sheet S, the image data correcting unit 121 can obtain the expansion/contraction ratio R of the sheet S (relative ratio of front/back lengths of sheet S) as follows.

$$R=378.86/380.00=99.70[\%]$$

Thus, in this case, the length of the sheet S in the conveying direction has contracted by approximately 1 mm by heat fixing, and therefore if the image lengths on the front/back sides of the sheet S are made to be the same, a front/back estimation deviation of approximately 1 mm occurs. Accordingly, the image data correcting unit 121 corrects the magnification ratio of the image to be printed on the back side of the sheet S based on the expansion/contraction ratio R, and the image forming unit 120 prints the image on the back side of the sheet S based on the corrected image data, so that the precision in the front/back estimation can be improved.

Note that in the above example, the image data correcting unit 121 obtains the expansion/contraction ratio R by calculating the conveying distances L1, L2 of the sheet S conveyed by the conveying means before and after the heat fixing; however, for example, the ratio of the number of pulses n1, n2 counted when conveying the sheet S before and after the heat fixing may be obtained as the expansion/contraction ratio R.

For example, the expansion/contraction ratio R can be obtained as follows, in a case where the number of pulses counted when the sheet S is conveyed before the heat fixing is n1=18816, and the number of pulses counted when the sheet S is conveyed after the heat fixing is n2=18759 in the above example.

$$R=n2/n1=18759/18816=99.70[\%]$$

Note that a length L of the sheet S in the conveying direction can be obtained as follows, by adding, to the sheet conveying length L obtained by formula (1), a distance a (=A+B) between the start trigger sensor 3 and the stop trigger sensor 4 illustrated in FIG. 2.

$$L=(n/N)\times 2\pi r+a \quad (3)$$

a: distance between start trigger sensor 3 and stop trigger sensor 4

As described above, the conveying distance calculating unit 111 can obtain the length of the sheet S in the conveying direction by formula (3) in which the distance a between the sensors is added to the conveying distance L of the sheet S conveyed by the sheet conveying means obtained by formula (1).

Furthermore, the image data correcting unit 121 can obtain the expansion/contraction ratio R by the following formula (4), based on the relative ratio of the length L of the sheet S in the conveying direction before and after the heat fixing by an electrophotographic method.

$$R=[(n2/N)\times 2\pi r+a]/[(n1/N)\times 2\pi r+a] \quad (4)$$

As described above, the image data correcting unit 121 of the sheet conveying device 100 can calculate the expansion/contraction ratio R from the length L of the sheet S in the conveying direction that is obtained with high precision by the conveying distance calculating unit 111. The image data correcting unit 121 corrects the magnification ratio of the image to be printed on the back side of the sheet S based on the calculated expansion/contraction ratio R, and the image forming unit 120 prints an image based on the corrected image data, so that the precision in the front/back estimation can be improved.

As described above, in the sheet conveying device 100 according to the present embodiment, the rotary encoder 18 is provided so as to be movable in accordance with the contacting/separating movement of the driven roller 12. Therefore, there is no need to provide a connection component such as a universal joint between the rotary encoder 18 and the driven roller 12. Therefore, costs of the connection component can be reduced and the size can be made compact by reducing the space for installing a connection component.

Furthermore, by the above configuration, the sheet conveying device 100 can obtain the conveying distance or the sheet length of the sheet S with high precision. The image forming apparatus 101 including such a sheet conveying device 100 can correct the magnification ratio of the image printed on the back side of the sheet S based on the conveying distance or the sheet length of the sheet S obtained with high precision by the sheet conveying device 100, so that the precision in the front/back estimation of the images printed on both sides of the sheet S can be improved.

According to one embodiment of the present invention, a sheet conveying device and an image forming apparatus are provided, which are capable of obtaining a sheet conveying distance with a configuration of low cost and a compact size.

The sheet conveying device and the image forming apparatus are not limited to the specific embodiments described herein, and variations and modifications may be made without departing from the scope of the present invention.

The present application is based on and claims the benefit of priority of Japanese Priority Patent Application No. 2012-287141, filed on Dec. 28, 2012, the entire contents of which are hereby incorporated herein by reference.

What is claimed is:

1. A sheet conveying device comprising:

a conveying unit configured to convey a sheet by a first rotating body and a second rotating body that is provided so as to be movable in a contacting/separating direction with respect to the first rotating body;

a rotation amount measuring unit configured to measure a rotation amount of the second rotating body, the rotation amount measuring unit being provided so as to be movable in the contacting/separating direction along with the second rotating body;

a conveying distance calculating unit configured to calculate a conveying distance of the sheet based on a measurement result obtained by the rotation amount measuring unit; and a support member configured to support a rotational shaft of the second rotating body so as to be movable in the contacting/separating direction, wherein the rotation amount measuring unit includes:

a wheel provided on the rotational shaft of the second rotating body, the wheel having slits carved therein at predetermined intervals, and a sensor configured to detect the slits, the sensor being provided on the support member;

wherein the support member is mounted to a frame supporting the first rotating body, wherein the support member forms a recess outside of the frame, and wherein the wheel and the sensor are within the recess.

2. The sheet conveying device according to claim 1, wherein the support member is mounted to the frame by a stepped screw.

3. The sheet conveying device according to claim 2, wherein an interval between the support member and the frame is greater than or equal to 0.1 mm and less than or equal to 3 mm.

4. The sheet conveying device according to claim 2, wherein the stepped screw is covered by a resin member at least a part contacting the support member.

5. The sheet conveying device according to claim 1, further comprising:

a pressing unit configured to press the support member in a direction that is orthogonal to the contacting/separating direction.

6. The sheet conveying device according to claim 1, further comprising:

a downstream side detecting unit configured to detect the sheet on a downstream side of the conveying unit in a conveying direction of the sheet; and an upstream side detecting unit configured to detect the sheet on an upstream side of the conveying unit in the conveying direction of the sheet, wherein the conveying distance calculating unit calculates the conveying distance of the sheet based on the rotation amount of the second rotating body measured by the rotation amount measuring unit from when the downstream side detecting unit detects the sheet to when the upstream side detecting unit detects the sheet.

7. The sheet conveying device according to claim 6, wherein the conveying distance calculating unit calculates a length of the sheet in the conveying direction by adding, to the calculated conveying distance of the sheet, a distance between the downstream side detecting unit and the upstream side detecting unit in a conveying path of the sheet.

8. The sheet conveying device according to claim 1, wherein the first rotating body is a driving roller that rotates, and the second rotating body is a driven roller that is rotated by the driving roller or by the sheet.

9. An image forming apparatus comprising:

the sheet conveying device according to claim 1.

* * * * *